US011712913B2

(12) United States Patent
Washizawa

(10) Patent No.: US 11,712,913 B2
(45) Date of Patent: Aug. 1, 2023

(54) LIQUID EJECTING DEVICE

(71) Applicant: Seiko Epson Corporation, Tokyo (JP)

(72) Inventor: Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,774

(22) Filed: Jan. 24, 2022

(65) Prior Publication Data

US 2022/0234375 A1 Jul. 28, 2022

(30) Foreign Application Priority Data

Jan. 26, 2021 (JP) ..... 2021-010230

(51) Int. Cl.

| | |
|---|---|
| ***B41J 25/00*** | (2006.01) |
| ***B41J 2/01*** | (2006.01) |
| ***B41J 29/38*** | (2006.01) |
| ***B41J 19/20*** | (2006.01) |
| ***B41J 2/21*** | (2006.01) |
| *B41J 19/00* | (2006.01) |

(52) U.S. Cl.

CPC ..... *B41J 25/006* (2013.01); *B41J 2/01* (2013.01); *B41J 2/2135* (2013.01); *B41J 19/205* (2013.01); *B41J 29/38* (2013.01); *B41J 19/00* (2013.01)

(58) Field of Classification Search

CPC . B41J 25/006; B41J 2/01; B41J 19/205; B41J 29/38; B41J 2/2135; B41J 19/00

See application file for complete search history.

(56) References Cited

U.S. PATENT DOCUMENTS

| | | | | |
|---|---|---|---|---|
| 2009/0189948 | A1* | 7/2009 | Nakata | B41J 19/005 347/37 |
| 2017/0015103 | A1* | 1/2017 | Ueki | B41J 2/17546 |
| 2017/0237866 | A1* | 8/2017 | Eiyama | B41J 19/207 358/1.5 |

FOREIGN PATENT DOCUMENTS

| | | | | |
|---|---|---|---|---|
| JP | 2007137005 A | * | 6/2007 | B41J 19/20 |
| JP | 2017-144717 | | 8/2017 | |
| JP | 2017-154452 | | 9/2017 | |

* cited by examiner

*Primary Examiner* — Yaovi M Ameh

(74) *Attorney, Agent, or Firm* — Workman Nydegger

(57) ABSTRACT

A liquid ejecting device includes a head configured to eject liquid, a holding unit holding the head, a base unit holding the holding unit, a guide unit movably holding the base unit, the guide unit being configured to guide the base unit, and a detection unit attached to the base unit, the detection unit being configured to detect vibration of the base unit, in which the base unit includes a first surface and a second surface opposite to the first surface, the guide unit is attached to the first surface, and the detection unit is attached to at least one of the first surface and the second surface.

6 Claims, 4 Drawing Sheets

LIQUID EJECTING DEVICE

The present application is based on, and claims priority from JP Application Serial Number 2021-010230, filed Jan. 26, 2021, the disclosure of which is hereby incorporated by reference herein in its entirety.

BACKGROUND

1. Technical Field

The present disclosure relates to a liquid ejecting device.

2. Related Art

JP-A-2017-154452 discloses a liquid ejecting device including a head configured to eject liquid, a holding unit holding the head, a guide unit movably holding the holding unit, the guide unit being configured to guide the holding unit, and a detection unit attached to the holding unit, the detection unit being configured to detect vibration of the holding unit. When guided by the guide unit, the holding unit vibrates with the part where the guide unit is attached as a fulcrum. The detection unit is attached to the holding unit at a position away from the position where the guide unit is attached. The detection unit detects the vibration of the holding unit at a position where the vibration of the holding unit is likely to increase. The liquid ejecting device corrects the landing position of the liquid ejected from the head by detecting the vibration of the holding unit by the detection unit.

In such a liquid ejecting device, when the guide unit is deteriorated, the operating load of moving the holding unit increases. As a result, vibration is generated in the holding unit. Since the vibration caused by the deterioration of the guide unit is weak, the detection unit may not be able to detect the vibration when the detection unit is attached to the holding unit at the position away from the position where the guide unit is attached, as in the liquid ejecting device described in JP-A-2017-154452.

SUMMARY

A liquid ejecting device that solves the above problem includes a head configured to eject liquid, a holding unit holding the head, a base unit holding the holding unit, a guide unit movably holding the base unit, the guide unit being configured to guide the base unit, and a detection unit attached to the base unit, the detection unit being configured to detect vibration of the base unit, in which the base unit includes a first surface and a second surface opposite to the first surface, the guide unit is attached to the first surface, and the detection unit is attached to at least one of the first surface and the second surface.

A liquid ejecting device that solves the above problem includes a head configured to eject liquid, a holding unit holding the head, a guide unit movably holding the holding unit, the guide unit being configured to guide the holding unit, and a detection unit provided at the holding unit, the detection unit being configured to detect vibration of the holding unit, in which the holding unit includes a first surface and a second surface opposite to the first surface, the guide unit is attached to the first surface, and the detection unit is attached to at least one of the first surface and the second surface.

DESCRIPTION OF EXEMPLARY EMBODIMENTS

A liquid ejecting device according to a first embodiment will be described below with reference to the accompanying drawings. The liquid ejecting device is, for example, an ink jet-type printer that ejects ink, as an example of liquids, to a medium such as a sheet of paper, fabric, or the like to print images such as characters, photographs, or the like on the medium.

First Embodiment

Figure 1:
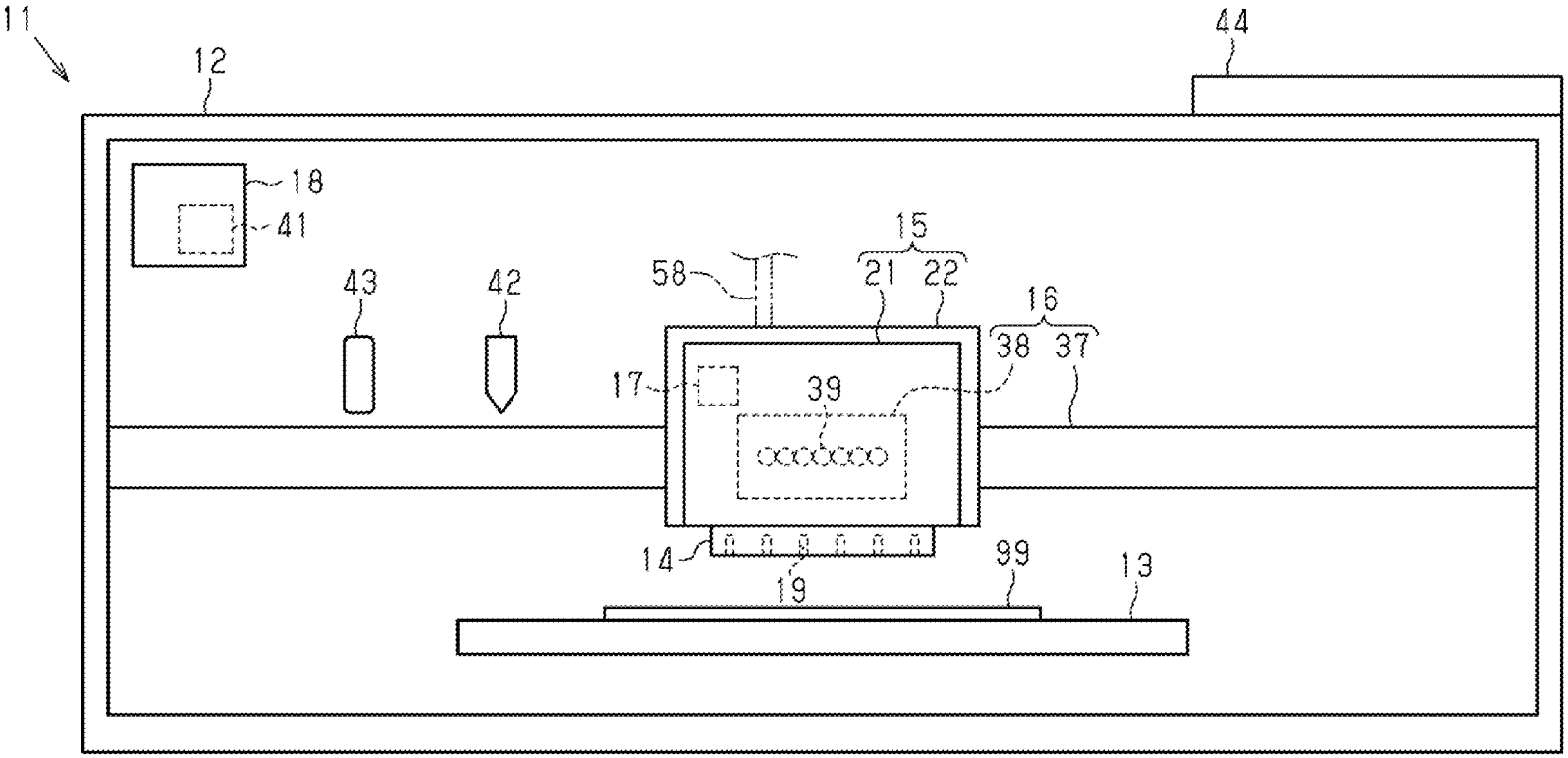
FIG. 1 is a front view illustrating a first embodiment of a liquid ejecting device.

As illustrated in FIG. 1, a liquid ejecting device 11 includes a housing 12, a support portion 13, a head 14, a carriage 15, a guide unit 16, a detection unit 17, and a control unit 18.

The housing 12 accommodates various constituting components provided in the liquid ejecting device 11.

The support portion 13 is configured to support a medium 99. For example, the support portion 13 supports the medium 99 that is transported.

The head 14 is configured to eject liquid. The head 14 includes one or more nozzle 19 that ejects liquid. The head 14 ejects the liquid from the nozzle 19 onto the medium 99 supported by the support portion 13 to print an image on the medium 99.

The head 14 is mounted on the carriage 15. The carriage 15 is movably attached to the guide unit 16. The carriage 15 scans over the medium 99 supported on the support portion 13. Thus, the liquid ejecting device 11 is a so-called serial-type liquid ejecting device.

Figure 2:
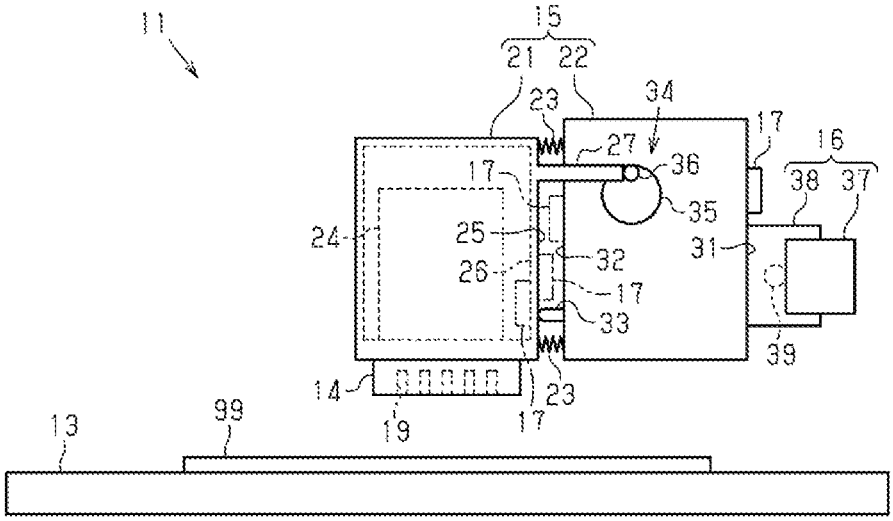
FIG. 2 is a side view of the liquid ejecting device illustrated in FIG. 1.

As illustrated in FIG. 2, the carriage 15 includes a holding unit 21 that holds the head 14, and a base unit 22 that holds the holding unit 21. The holding unit 21 and the base unit 22 are joined by, for example, one or more spring 23. Thus, the holding unit 21 is held by the base unit 22.

The holding unit 21 is configured such that, for example, a liquid reservoir 24 that stores liquid is mountable. For example, the interior of the holding unit 21 is hollow to allow the liquid reservoir 24 to be mounted therein. The liquid stored in the liquid reservoir 24 is supplied to the head 14 when the liquid reservoir 24 is mounted in the holding unit 21.

The holding unit 21 includes an upstream holding surface 25 and a downstream holding surface 26. The upstream holding surface 25 is a surface facing upstream in the transport direction which is the direction in which the medium 99 is transported. The upstream holding surface 25 is a surface facing the base unit 22. The upstream holding surface 25 is an outer surface of the holding unit 21. The upstream holding surface 25 is a surface to which the spring 23 is attached. The downstream holding surface 26 is a surface facing downstream in the transport direction. The downstream holding surface 26 is a surface facing away from the upstream holding surface 25. The downstream holding surface 26 is an inner surface of the holding unit 21.

The holding unit 21 includes a protrusion 27 that extends toward the base unit 22. For example, the protrusion 27 extends from the upstream holding surface 25. The tip of the protrusion 27 contacts the base unit 22.

For example, the base unit 22 is located upstream of the head 14 in the transport direction. The base unit 22 includes an upstream base surface 31 and a downstream base surface 32. The upstream base surface 31 is a surface facing upstream in the transport direction. The upstream base surface 31 is an outer surface of the base unit 22. The upstream base surface 31 is a surface to which the guide unit 16 is attached. The downstream base surface 32 is a surface facing downstream in the transport direction. The downstream base surface 32 is a surface facing away from the upstream base surface 31. The downstream base surface 32 is a surface facing the holding unit 21, and more particularly, a surface facing the upstream holding surface 25. The downstream base surface 32 is an outer surface of the base unit 22. The downstream base surface 32 is a surface to which the spring 23 is attached.

The base unit 22 includes a pin 33 that extends toward the holding unit 21. The pin 33 extends from the downstream base surface 32. The tip of the pin 33 contacts the upstream holding surface 25. The pin 33 contacts the upstream holding surface 25 at a position lower than the position where the protrusion 27 extends. The holding unit 21 joined to the base unit 22 with the spring 23 is supported by the pin 33.

The base unit 22 includes a displacement mechanism 34 that displaces the holding unit 21 relative to the base unit 22. The displacement mechanism 34 includes, for example, a rotating body 35 that is configured to rotate. The rotating body 35 includes a contact portion 36 that contacts the tip of the protrusion 27. When the rotating body 35 rotates in a state where the protrusion 27 and the contact portion 36 are in contact with each other, the holding unit 21 is displaced relative to the base unit 22 with the tip of the pin 33 as a fulcrum.

Displacement of the holding unit 21 relative to the base unit 22 changes the distance between the head 14 and the support portion 13. In other words, the distance between the medium 99 supported on the support portion 13 and the head 14 changes. In this way, the displacement mechanism 34 adjusts the distance between the head 14 and the medium 99 to an appropriate distance depending on, for example, the thickness of the medium 99.

The carriage 15 includes a first surface and a second surface. The first surface is a surface to which the guide unit 16 is attached. The second surface is a surface opposite to the first surface. The second surface is a surface facing away from the first surface. In the first embodiment, the holding unit 21 includes a first surface and a second surface. The first surface of the holding unit 21 is the upstream holding surface 25, and the second surface of the holding unit 21 is the downstream holding surface 26. In the first embodiment, the base unit 22 includes a first surface and a second surface. The first surface of the base unit 22 is the upstream base surface 31, and the second surface of the base unit 22 is the downstream base surface 32. The upstream holding surface 25 is a surface on which the spring 23 is attached, with which the pin 33 comes into contact, and to which therefore the guide unit 16 is indirectly attached via the base unit 22. The upstream base surface 31 is a surface to which the guide unit 16 is directly attached.

The guide unit 16 is located upstream of the head 14 in the transport direction, for example. The guide unit 16 movably holds the carriage 15. The guide unit 16 is configured to guide the carriage 15. In the first embodiment, the guide unit 16 movably holds the base unit 22. The guide unit 16 is configured to guide the base unit 22. In the first embodiment, the guide unit 16 movably holds the holding unit 21 via the base unit 22. The guide unit 16 is configured to guide the holding unit 21 via the base unit 22.

The guide unit 16 includes, for example, a rail 37 and a block 38. The rail 37 is an elongated member extending across the width of the housing 12. For example, the rail 37 is fixed to the housing 12. The block 38 is attached to the rail 37 in a movable manner along the rail 37. The block 38 is attached to the carriage 15. In the first embodiment, the block 38 is attached to the upstream base surface 31. The block 38 is fixed with, for example, a screw to the upstream base surface 31. As the block 38 moves along the rail 37, the carriage 15 moves along the rail 37. In this way, the guide unit 16 guides the carriage 15 while holding the carriage 15.

The block 38 includes, for example, a plurality of rolling elements 39 in the block 38. As the block 38 moves relative to the rail 37, the rolling elements 39 roll within the block 38. This allows the block 38 to move smoothly relative to the rail 37. The block 38 is filled with lubricant to facilitate rolling of the rolling elements 39.

The guide unit 16 is, for example, an LM guide (trade name). The guide unit 16 may be a ball screw. Any configuration of the guide unit 16 that holds the carriage 15 and guides the carriage 15 can be used. In the case of the ball screw, the guide unit 16 includes a screw corresponding to the rail 37 and a nut corresponding to the block 38. In this case, for example, the rolling elements 39 are disposed between the screw and the nut.

The detection unit 17 is attached to the carriage 15. The detection unit 17 is attached to at least one of the first surface and the second surface. In other words, the detection unit 17 is attached to at least one of the upstream holding surface 25, the downstream holding surface 26, the upstream base surface 31, and the downstream base surface 32. In the first embodiment, the detection unit 17 is attached to the upstream base surface 31 which is the first surface of the base unit 22.

The detection unit 17 detects vibration of the carriage 15. For example, the detection unit 17 detects the vibration of the carriage 15 when the carriage 15 moves during printing. When the detection unit 17 is attached to the base unit 22, the detection unit 17 detects the vibration of the base unit 22. When the detection unit 17 is attached to the holding unit 21, the detection unit 17 detects the vibration of the holding unit 21. The detection unit 17 is provided as, for example, an actuator. The detection unit 17 outputs a signal in response to the detected vibration. The signal is an oscillatory waveform representing the detected vibration, and is a result of detection by the detection unit 17. For example, the detection unit 17 outputs a signal to the control unit 18.

When the guide unit 16 is deteriorated, the operation load, which is a load of moving of the carriage 15, increases. For example, the degrading of the guide unit 16 is caused by a decrease of the lubricant, trapping or adhesion of a foreign material, or the like. The guide unit 16 is deteriorated, for example, when the lubricant filled in the guide unit 16 decreases. The guide unit 16 is deteriorated when, for example, the foreign material is trapped between the rail 37 and the block 38, or introduced in the block 38, and is trapped in the guide unit 16. The guide unit 16 is deteriorated when, for example, the foreign material adheres to the rail 37.

An increase of the operation load of the carriage 15 causes the vibration to be generated in the carriage 15 when the carriage 15 moves. The detection unit 17 detects this vibration generated when the carriage 15 moves. As the operation load increases, the carriage 15 is ultimately unable to move.

Since the base unit 22 is directly attached to the guide unit 16 in the first embodiment, the vibration is generated in the base unit 22 when the carriage 15 moves. Accordingly, the detection unit 17 detects the vibration of the base unit 22 as the vibration of the carriage 15.

The detection unit 17 is attached to at least one of the first surface and the second surface. In this case, the detection unit 17 is attached at a position relatively close to the guide unit 16, for example, compared to a case in which the detection unit 17 is attached to the outer surface of the holding unit 21 that faces downstream in the transport direction. This makes it easier for the detection unit 17 to detect the vibration of the carriage 15.

When the lubricant of the guide unit 16 decreases, periodic vibrations are generated when the block 38 moves in accordance with an arrangement pitch of the rolling elements 39. In this case, a high-frequency vibration appears as the vibration of the carriage 15. In the first embodiment, the vibration having a first frequency is generated due to a decrease, for example, of the lubricant.

When the foreign material, such as dust in the air or powder generated from the medium 99, is trapped in the guide unit 16, periodic vibrations are generated when the block 38 moves. In this case, the vibration having a lower frequency than the first frequency is generated as the vibration of the carriage 15. In the first embodiment, the trapping of the foreign material generates, for example, vibration having a second frequency.

When the foreign material is adhered to the guide unit 16, for example, at a specific point on the rail 37, a one-off vibration is generated when the block 38 passes through the point. In this case, therefore, the vibration having a lower frequency than the second frequency is generated as the vibration of the carriage 15. In the first embodiment, the adhesion of the foreign material generates, for example, the vibration having a third frequency.

As described above, the vibration having a specific frequency generated in the carriage 15 is related to the deterioration factor of the guide unit 16. The specific frequency is, for example, the first frequency, the second frequency, or the third frequency.

The vibration having the specific frequency generated in the carriage 15 is related to the deterioration factor of the guide unit 16 even when the guide unit 16 is a ball screw, as in the case of the LM guide. For example, in the case of the ball screw, a plurality of vibrations having different frequencies are generated in the carriage 15 due to the decrease of the lubricant between the screw and the nut, the trapping of the foreign material between the screw and the nut, or the adhesion of the foreign material to the screw, respectively.

As illustrated in FIG. 1, the control unit 18 is fixed to, for example, the housing 12. The control unit 18 is configured to comprehensively control the liquid ejecting device 11. The control unit 18 may be configured as a circuit including α: at least one processor configured to perform various processing according to a computer program, β: at least one dedicated hardware circuit, such as an application-specific integrated circuit (ASIC), which is configured to execute at least part of the various processing, or γ: a combination of α and β. The processor includes a central processing unit (CPU) and a memory such as a random access memory (RAM) or a read-only memory (ROM) that stores program code or a command that causes the CPU to execute processing. The memory, or a computer readable medium includes any readable medium accessible by a general purpose or special purpose computer.

The control unit 18 analyzes the vibration detected by, for example, the detection unit 17. By executing the program stored in the control unit 18, the control unit 18 functions as an analysis unit 41 that analyzes the vibration detected by the detection unit 17. In this respect, the control unit 18 includes the analysis unit 41. In other words, the liquid ejecting device 11 includes the analysis unit 41.

The analysis unit 41 may be a circuit provided separately from the control unit 18. In this case, the control unit 18 transmits the signal received from the detection unit 17 to the analysis unit 41. After the analysis, the analysis unit 41 transmits the analysis result to the control unit 18.

The analysis unit 41 analyzes the signal by, for example, Fourier transform. The analysis unit 41 may analyze the signal by passing the signal through a filter such as a low-pass filter, a high-pass filter, a band-pass filter, or the like. By analyzing the signal, the analysis unit 41 extracts the vibration having a specific frequency from the signal. The vibration having the specific frequency is the analysis result of the analysis unit 41.

The liquid ejecting device 11 may include an application unit 42. The application unit 42 is configured to provide lubricant to the guide unit 16. For example, the application unit 42 provides lubricant between the rail 37 and the block 38. When the guide unit 16 is the LM guide, the block 38 usually formed with a hole in it for the lubricant to be injected. By injecting the lubricant into the hole, the application unit 42 provides the lubricant to the guide unit 16.

The liquid ejecting device 11 may include a wiping unit 43. The wiping unit 43 is configured to wipe the guide unit 16. For example, the wiping unit 43 wipes the rail 37. The wiping unit 43 is, for example, a cloth wiper. By wiping the guide unit 16, the wiping unit 43 removes the foreign material adhered to the guide unit 16.

The liquid ejecting device 11 includes a display unit 44. The display unit 44 is, for example, a liquid crystal monitor. For example, the display unit 44 is fixed to the housing 12. The display unit 44 displays information related to the operating status of the liquid ejecting device 11. The operating status includes, for example, the operating time, the amount of the remaining liquid, the state of the guide unit 16, and the like. The display unit 44 may display a message indicating, for example, a deterioration state of the guide unit 16.

Next, the operation of the control unit 18 is described.

Figure 3:
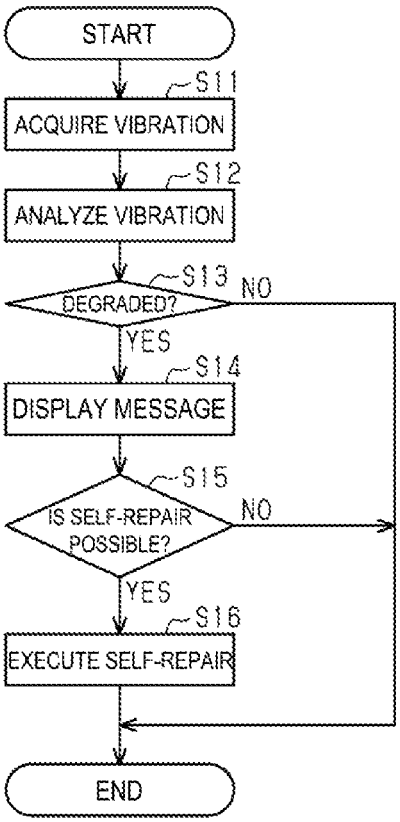
FIG. 3 is a flowchart illustrating processing executed by a control unit.

As printing starts, for example, the control unit 18 starts processing as illustrated in FIG. 3. Therefore, the processing illustrated in FIG. 3 is executed in parallel with printing. The processing illustrated in FIG. 3 is the processing to determine the deterioration of the guide unit 16. The processing illustrated in FIG. 3 is also the processing to determine the deterioration factor of the guide unit 16. By determining the deterioration of the guide unit 16, it is possible to perform maintenance before the carriage 15 becomes unmovable. In other words, a sign that the carriage 15 would become unmovable can be obtained.

As illustrated in FIG. 3, the control unit 18 acquires the vibration detected by the detection unit 17 in step S11. In other words, the control unit 18 measures the vibration of the base unit 22. At this time, the control unit 18 may acquire the vibration in a section where the carriage 15 moves from the home position to the opposite anti-home position. The control unit 18 may also acquire the vibration in a section where the carriage 15 moves from the home position to the home position, i.e., a section where the carriage 15 reciprocates.

In step S12, the control unit 18 causes the analysis unit 41 to analyze the acquired vibration. By doing this, the control unit 18 obtains the analysis result of the signal.

In step S13, the control unit 18 determines whether the guide unit 16 is deteriorated based on the analysis result. In other words, the control unit 18 determines whether the guide unit 16 is deteriorated based on the detection result of the detection unit 17. When the control unit 18 determines that the guide unit 16 is deteriorated, the control unit 18 shifts the processing to step S14. When the control unit 18 determines that the guide unit 16 is not deteriorated, the control unit 18 terminates the processing illustrated in FIG. 3. In this case, the control unit 18 continues printing.

In step S13, the control unit 18 determines the deterioration of the guide unit 16 by, for example, comparing the analysis result with a threshold. The threshold is stored in, for example, the control unit 18.

In step S13, the control unit 18 compares, for example, an intensity of the vibration having a specific frequency provided as the analysis result with the threshold. The control unit 18 compares, for example, the intensity of the vibration having the first frequency with a first threshold. The control unit 18 compares, for example, the intensity of the vibration having the second frequency with a second threshold. The control unit 18 compares, for example, the intensity of the vibration having the third frequency with a third threshold. For example, the first threshold, the second threshold, and the third threshold have different values.

In step S13, the control unit 18 determines that the guide unit 16 is deteriorated when the intensity of the vibration having the specific frequency exceeds a corresponding threshold. When the intensity of the vibration having the specific frequency does not exceed the corresponding threshold, the control unit 18 determines that the guide unit 16 is not deteriorated. In other words, in step S13, the control unit 18 determines the deterioration of the guide unit 16 based on the vibration having the specific frequency provided as the analysis result, and also determines the deterioration factor.

In step S13, when the intensity of the vibration having the first frequency exceeds the first threshold, the control unit 18 determines that the guide unit 16 is deteriorated and also determines that the deterioration factor of the guide unit 16 is the decrease of the lubricant. When the intensity of the vibration having the second frequency exceeds the second threshold, the control unit 18 determines that the guide unit 16 is deteriorated and also determines that the deterioration factor of the guide unit 16 is the trapping of the foreign material. When the intensity of the vibration having the third frequency exceeds the third threshold, the control unit 18 determines that the guide unit 16 is deteriorated and also determines that the deterioration factor of the guide unit 16 is the adhesion of the foreign material.

In step S14, the control unit 18 causes the display unit 44 to display a message indicating the state of the guide unit 16. The message indicates that the guide unit 16 is deteriorated. The message indicates the deterioration factor of the guide unit 16. In other words, the control unit 18 causes the display unit 44 to indicate the deterioration of the guide unit 16 based on the detection result of the detection unit 17. The control unit 18 causes the display unit 44 to display the deterioration factor of the guide unit 16 based on the detection result of the detection unit 17. For example, the control unit 18 stores a data table as shown in Table 1. The control unit 18 selects a message to be displayed on the display unit 44, for example, by referring to the data table.

TABLE 1

| FLAG | MESSAGE |
|---|---|
| FIRST FLAG | FIRST MESSAGE |
| SECOND FLAG | SECOND MESSAGE |
| THIRD FLAG | THIRD MESSAGE |

As shown in Table 1, the data table stores flags and messages in an associated manner. For example, a first flag is associated with a first message. A second flag is associated with a second message. A third flag is associated with a third message. The first flag is a flag that is satisfied when the intensity of the vibration having the first frequency exceeds the first threshold. The second flag is a flag that is satisfied when the intensity of the vibration having the second frequency exceeds the second threshold. The third flag is a flag that is satisfied when the intensity of the vibration having the third frequency exceeds the third threshold. The first message is a message indicating the decrease of the lubricant. The second message is a message indicating the trapping of the foreign material. The third message is a message indicating the adhesion of the foreign material.

When the intensity of the vibration having the first frequency exceeds the first threshold, i.e., the first flag is satisfied, the control unit 18 causes the display unit 44 to display the first message in step S14. When the intensity of the vibration having the second frequency exceeds the second threshold, i.e., the second flag is satisfied, the control unit 18 causes the display unit 44 to display the second message. When the intensity of the vibration having the third frequency exceeds the third threshold, i.e., the third flag is satisfied, the control unit 18 causes the display unit 44 to display the third message. This allows the user to understand the deterioration of the guide unit 16 and the deterioration factor of the guide unit 16. Thus, the message displayed in step S14 is different for each deterioration factor of the guide unit 16. The display unit 44 may display a plurality of messages.

The message displayed on the display unit 44 may include a message indicating a countermeasure for the deterioration factor. In this case, the control unit 18 causes the display unit 44 to display a message indicating the deterioration factor of the guide unit 16 and the countermeasure for the deterioration factor. The message indicating the countermeasure is, for example, a message urging maintenance or a message urging contact to the support center. For example, the first message may include a message urging provision of the lubricant as the countermeasure. The second message may include a message urging removal of the foreign material trapped in the guide unit 16 as the countermeasure. The third message may include a message urging removal of the foreign material adhered to the guide unit 16 as the countermeasure.

As illustrated in FIG. 3, the control unit 18 determines, in step S15, whether self-repair is possible to deal with the deterioration factor of the guide unit 16. The self-repair means maintenance performed by the control unit 18 itself relative to the guide unit 16. In other words, the control unit 18 determines whether the deterioration factor of the guide unit 16 is the deterioration factor that is repairable by the application unit 42 or the wiping unit 43. When the control unit 18 determines that the self-repair is possible, the process shifts to step S16. When the control unit 18 determines that the self-repair is not possible, the control unit 18 terminates the processing. In this case, the printing continues with the message displayed on the display unit 44.

In the first embodiment, when the deterioration factor is the decrease of the lubricant or the adhesion of the foreign material, the control unit 18 determines that the self-repair is possible. When the deterioration factor is the trapping of the foreign material, the control unit 18 determines that the self-repair is not possible. In this case, the display unit 44 displays the message indicating, for example, maintenance procedures, contact information to a support center, or the like.

The control unit 18 executes the self-repair in step S16. For example, when the deterioration factor of the guide unit 16 is the decrease of the lubricant, the control unit 18 controls the application unit 42. In other words, when the control unit 18 determines that the deterioration factor is the decrease of the lubricant in the guide unit 16, the control unit 18 controls the application unit 42 to provide the lubricant. For example, when the deterioration factor of the guide unit 16 is the adhesion of the foreign material, the control unit 18 controls the wiping unit 43. In other words, the control unit 18 wipes the rail 37 by controlling the wiping unit 43 when the control unit 18 determines that the deterioration factor is the adhesion of the foreign material.

In step S16, the control unit 18 may execute the self-repair after pausing the printing, or may execute the self-repair after the printing ends. The control unit 18 may request permission from the user before executing the self-repair. When the permission is obtained from the user, the control unit 18 executes the self-repair. When the permission is not obtained from the user, the control unit 18 terminates the processing illustrated in FIG. 3. After the self-repair is completed, the control unit 18 ends the processing illustrated in FIG. 3.

Next, the effects of the first embodiment is described.

(1) The detection unit 17 is attached to at least one of the first surface of the base unit 22 and the second surface of the base unit 22.

When the guide unit 16 is deteriorated, the vibration is generated in the base unit 22 when the base unit 22 moves. Since this vibration is weak, when the detection unit 17 is attached to the base unit 22 at a position away from the position where the guide unit 16 is attached, there is a possibility that the vibration wave is attenuated and the vibration cannot be detected. In this regard, according to the above-described configuration, the detection unit 17 is attached to the base unit 22 at a position relatively close to the position where the guide unit 16 is attached. Accordingly, the detection unit 17 can detect the vibration generated due to the deterioration of the guide unit 16.

(2) The detection unit 17 is attached to at least one of the first surface of the holding unit 21 and the second surface of the holding unit 21.

When the guide unit 16 is deteriorated, the vibration is generated in the holding unit 21 when the holding unit 21 moves. Since this vibration is weak, when the detection unit 17 is attached to the holding unit 21 at a position away from the position where the guide unit 16 is attached, there is a possibility that the vibration cannot be detected. In this regard, according to the above-described configuration, the detection unit 17 is attached to the holding unit 21 at a position relatively close to the position where the guide unit 16 is attached. Accordingly, the detection unit 17 can detect the vibration generated due to the deterioration of the guide unit 16.

(3) When the control unit 18 determines that the guide unit 16 is deteriorated based on the detection result of the detection unit 17, the control unit 18 causes the display unit 44 to indicate the deterioration of the guide unit 16.

The above configuration allows the user to understand the deterioration of the guide unit 16.

(4) The control unit 18 determines the deterioration factor of the guide unit 16 based on the vibration having the specific frequency extracted by analyzing the detection result of the detection unit 17, and causes the display unit 44 to display the deterioration factor.

The deterioration factor of the guide unit 16 is related to the frequency of the vibration detected by the detection unit 17. Accordingly, the control unit 18 can determine the deterioration factor of the guide unit 16 based on the vibration having the specific frequency extracted from the detection result of the detection unit 17. According to the above-described configuration, the user can recognize the deterioration factor of the guide unit 16.

(5) When the control unit 18 determines that the deterioration factor is the decrease of the lubricant in the guide unit 16, the control unit 18 provides the lubricant by controlling the application unit 42.

According to the configuration described above, when the guide unit 16 is deteriorated due to the decrease of the lubricant in the guide unit 16, the lubricant is automatically provided between the rail 37 and the block 38 by the application unit 42. Therefore, the guide unit 16 can be appropriately maintained.

(6) The control unit 18 causes the display unit 44 to display the message indicating the deterioration factor and the countermeasure for the deterioration factor.

According to the above-described configuration, the user can understand the countermeasure for the deterioration factors of the guide unit 16.

Second Embodiment

Next, a second embodiment of the liquid ejecting device 11 will be described. In the second embodiment, the configuration of the carriage 15 differs from that of the first embodiment. In the second embodiment, what differs from the first embodiment will mainly be described.

Figure 4:
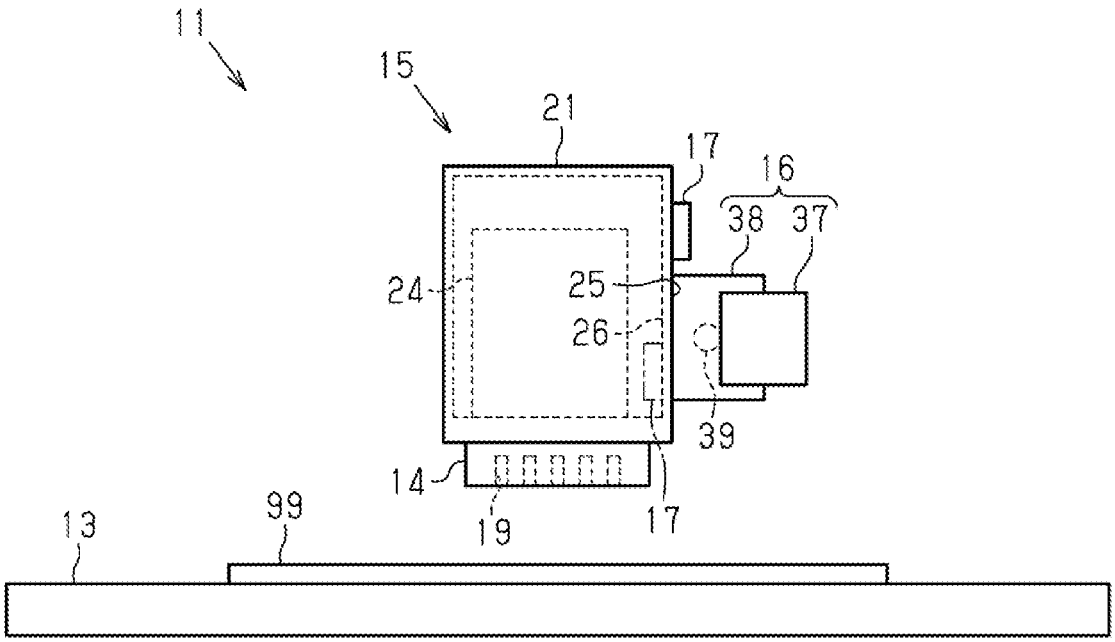
FIG. 4 is a side view illustrating a second embodiment of a liquid ejecting device.

As illustrated in FIG. 4, in the second embodiment, the carriage 15 does not include the base unit 22 and includes the holding unit 21. Accordingly, in the second embodiment, the holding unit 21 is directly held by the guide unit 16.

In the second embodiment, the detection unit 17 is attached to the holding unit 21. The detection unit 17 is attached to at least one of the first surface and the second surface of the holding unit 21. In other words, the detection unit 17 is attached to at least one of the upstream holding surface 25 and the downstream holding surface 26. In the second embodiment, the detection unit 17 is attached to the upstream holding surface 25. Accordingly, the detection unit 17 detects the vibration of the holding unit 21 as the vibration of the carriage 15.

The detection unit 17 is attached to at least one of the first surface of the holding unit 21 and the second surface of the holding unit 21. In this case, the detection unit 17 is disposed at a position relatively close to the guide unit 16, for example, compared to the case in which the detection unit 17 is attached to the outer surface of the holding unit 21 that faces downstream in the transport direction. This makes it easier for the detection unit 17 to detect the vibration of the carriage 15.

In the second embodiment described above, the effects listed above can be obtained except for the effect (1).

The first embodiment and the second embodiment can be implemented with the following changes. The first embodiment, the second embodiment, and a modified example described below can be implemented in combination with each other in a range not to cause technical contradictions.

Figure 5:
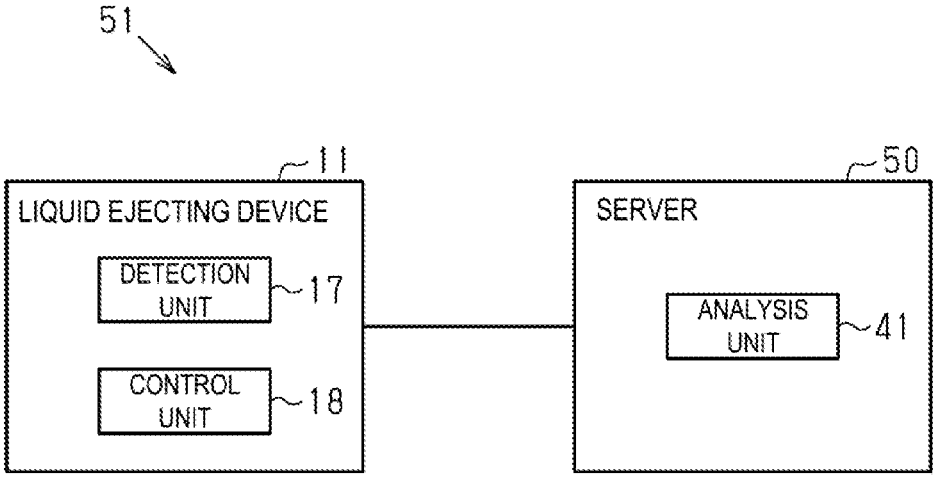
FIG. 5 is a block diagram illustrating a printing system including the liquid ejecting device.

As illustrated in FIG. 5, the liquid ejecting device 11 may be coupled to a server 50 including an analysis unit 41 to provide a printing system 51. In this case, the liquid ejecting device 11 transmits the detection result of the detection unit 17 to the server 50. The server 50 causes the analysis unit 41 to analyze the detection result of the detection unit 17. The server 50 transmits the analysis result of the analysis unit 41 to the liquid ejecting device 11. The control unit 18 determines the deterioration of the guide unit 16 and the deterioration factor of the guide unit 16 based on the received analysis result.

Figure 6:
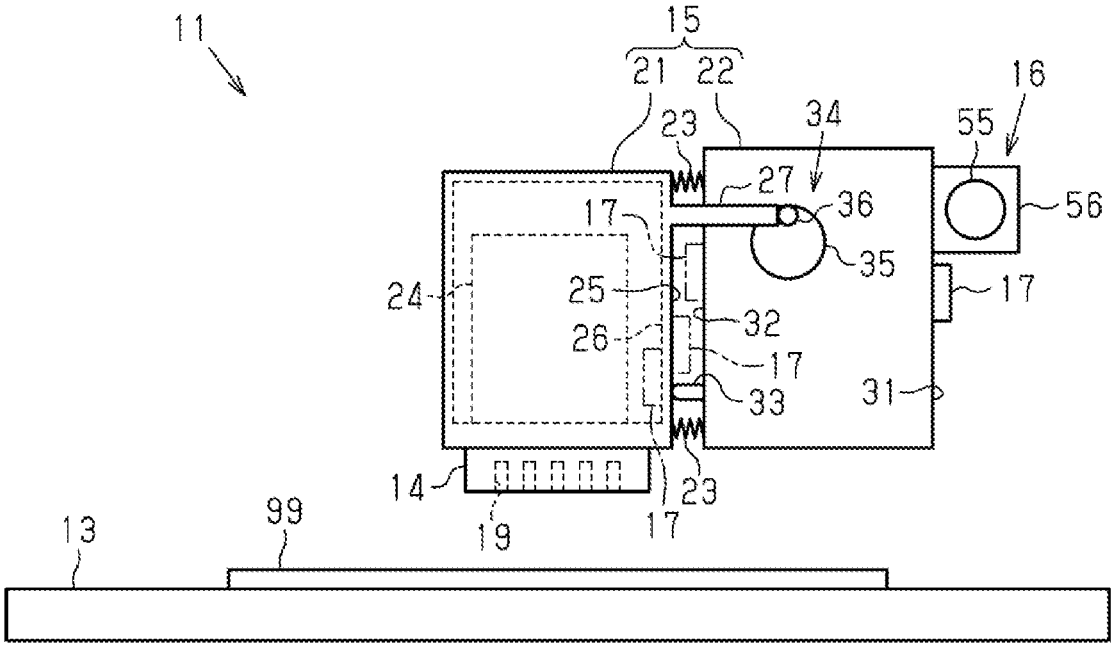
FIG. 6 is a side view illustrating a modified example of the liquid ejecting device.

As illustrated in FIG. 6, the guide unit 16 may be a guide shaft 55 that supports the carriage 15 and guides the carriage 15. In the modified example, the carriage 15 includes a mounting unit 56 attached to the guide shaft 55. The mounting unit 56 is provided on the base unit 22 and protrudes upstream from the upstream base surface 31 in the transport direction. Accordingly, the upstream base surface 31 from which the mounting unit 56 protrudes becomes the surface to which the guide unit 16 is attached, i.e., a first surface of the base unit 22.

The guide shaft 55, for example, passes through the mounting unit 56. In the case of the guide shaft 55, the lubricant provided to the guide shaft 55 may decrease, the foreign material may be trapped between the carriage 15 and the guide shaft 55, or the foreign material may adhere to a specific location on the guide shaft 55. In this case, like the case of the LM guide, the frequency of the vibration corresponds to the deterioration factor.

In the second embodiment, the holding unit 21 may include the mounting unit 56. In this case, the mounting unit 56 protrudes from, for example, the upstream holding surface 25.

There may be more than one threshold provided corresponding to the intensity of the vibration having the specific frequency. For example, the control unit 18 may store a first threshold including a plurality of thresholds, a second threshold including a plurality of thresholds, and a third threshold including a plurality of thresholds. In this case, the control unit 18 can make detailed determination about the deterioration state of the guide unit 16 based on the plurality of thresholds. The greater the intensity of the vibration having the specific frequency, the more advanced the deterioration of the guide unit 16 is. By making the detailed determination about the deterioration state, the control unit 18 can estimate the service life of the guide unit 16.

As illustrated in FIG. 1, the control unit 18 may determine a defect in a coupling element 58 coupled to the carriage 15 based on the detection result of the detection unit 17. The coupling element 58 is, for example, a cable to which electric power is supplied, a signal line to which signals are supplied, a tube to which liquid is supplied, or the like. The tube is coupled to the liquid reservoir 24 through the carriage 15.

When the coupling element 58 is dislodged or shredded from the carriage 15, the vibration is generated in the carriage 15. By detecting the vibration by the detection unit 17, the control unit 18 determines that the defect has occurred in the coupling element 58. In particular, since the carriage 15 is configured only by the holding unit 21 in the second embodiment, the coupling element 58 is coupled to the holding unit 21. When the defect occurs in the coupling element 58, the holding unit 21 vibrates. In the second embodiment, since the detection unit 17 is attached to the holding unit 21 to which the guide unit 16 is directly attached, it is easy to determine both the deterioration state of the guide unit 16 and the defect of the coupling element 58.

The control unit 18 may determine the contact between the head 14 or the carriage 15 and the medium 99 based on the detection result of the detection unit 17. For example, when the medium 99 supported on the support portion 13 is lifted from the support portion 13, the medium 99 may contact the head 14 or the carriage 15. When the head 14 or the carriage 15 contacts the medium 99, the vibration is generated in the carriage 15. By detecting the vibration by the detection unit 17, the control unit 18 determines that the head 14 or the carriage 15 has contacted the medium 99. In this case, the control unit 18 pauses the printing, and transports and ejects the medium. In the first embodiment, the position of the head 14 may be adjusted by the displacement mechanism 34 after the medium 99 is ejected. In the second embodiment, since the detection unit 17 is attached to the holding unit 21 to which the guide unit 16 is directly attached, it is easy to determine both the deterioration state of the guide unit 16 and the contact with the medium 99.

When it is determined that the foreign material is adhered to the guide unit 16, the control unit 18 may identify the location where the foreign material is adhered based on the analysis result. The control unit 18 may cause the display unit 44 to display the location where the foreign material is adhered. In this case, maintainability is improved.

The control unit 18 may determine whether the guide unit 16 is deteriorated based on the detection result of the detection unit 17 without analyzing the detection result in the analysis unit 41. For example, the control unit 18 may determine about the deterioration of the guide unit 16 by comparing the vibration generated when the guide unit 16 is not deteriorated with the vibration generated when the guide unit 16 is deteriorated.

The liquid ejected from the head 14 may not be ink, and can be, for example, liquid that contains particles of functional materials dispersed or mixed in the liquid. For example, the head 14 may eject liquid containing materials, in the form of dispersion or dissolution, such as electrode materials or pixel materials used in the manufacture of a liquid crystal display, an electroluminescent (EL) display, a surface emitting display, or the like.

Hereinafter, technical concepts and effects thereof that are understood from the above-described exemplary embodiments and modified examples will be described.

(A) A liquid ejecting device includes a head configured to eject liquid, a holding unit holding the head, a base unit holding the holding unit, a guide unit movably holding the base unit, the guide unit being configured to guide the base unit, and a detection unit attached to the base unit, the detection unit being configured to detect vibration of the base unit, in which the base unit includes a first surface and a second surface opposite to the first surface, the guide unit is attached to the first surface, and the detection unit is attached to at least one of the first surface and the second surface.

When the guide unit is deteriorated, the vibration is generated in the base unit when the base unit moves. Since this vibration is weak, when the detection unit is attached to the base unit at a position away from the position where the guide unit is attached, there is a possibility that the vibration is attenuated and the vibration may not be detected. In this regard, according to the configuration described above, the detection unit is attached to the base unit at a position relatively close to the position where the guide unit is attached. Accordingly, the detection unit can detect the vibration caused by the deterioration of the guide unit.

(B) A liquid ejecting device includes a head configured to eject liquid, a holding unit holding the head, a guide unit movably holding the holding unit, the guide unit being configured to guide the holding unit, and a detection unit provided at the holding unit, the detection unit being configured to detect vibration of the holding unit, in which the holding unit includes a first surface and a second surface opposite to the first surface, the guide unit is attached to the first surface, and the detection unit is attached to at least one of the first surface and the second surface.

When the guide unit is deteriorated, the vibration is generated in the holding unit when the holding unit moves. Since this vibration is weak, when the detection unit is attached to the holding unit at a position away from the position where the guide unit is attached, there is a possibility that the vibration may not be detected. In this regard, according to the configuration described above, the detection unit is attached to the holding unit at a position relatively close to the position where the guide unit is attached. Accordingly, the detection unit can detect the vibration caused by the deterioration of the guide unit.

(C) The liquid ejecting device may include a display unit and a control unit, in which the control unit may cause the display unit to indicate that the guide unit is deteriorated when the control unit determines the deterioration of the guide unit based on a detection result of the detection unit.

The above-described configuration allows the user to understand the deterioration of the guide unit.

(D) In the liquid ejecting device, the control unit may determine a deterioration factor of the guide unit based on vibration having a specific frequency extracted by analyzing the detection result of the detection unit, and cause the display unit to display the deterioration factor.

The deterioration factor of the guide unit is related to the frequency of the vibration detected by the detection unit. Accordingly, the control unit can determine the deterioration factor of the guide unit based on the vibration of the specific frequency extracted from the detection result of the detection unit. The above-described configuration allows the user to understand the deterioration factor of the guide unit.

(E) In the liquid ejecting device described above, the liquid ejecting device may include an application unit, in which the guide unit may include a rail and a block that is attached to the first surface, the block is configured to move along the rail, the application unit is configured to provide lubricant between the rail and the block, and the control unit may control the application unit to provide the lubricant when the control unit determines that the deterioration factor is a decrease of the lubricant in the guide unit.

According to the above-described configuration, when the guide unit is deteriorated due to the decrease of the lubricant in the guide unit, the lubricant is automatically provided between the rail and the block by the application unit. Accordingly, the guide unit can be appropriately maintained.

(F) In the liquid ejecting device described above, the control unit may cause the display unit to display a message indicating the deterioration factor and a countermeasure for the deterioration factor.

The above-described configuration allows the user to understand the countermeasure for the deterioration factor of the guide unit.

What is claimed is:

1. A liquid ejecting device, comprising:
a head configured to eject liquid;
a holding unit holding the head;
a base unit holding the holding unit;
a displacement mechanism operatively coupling the holding unit and the base unit, and biasing the holding unit toward the base unit while maintaining a gap between the holding unit and the base unit;
a guide unit movably holding the base unit, the guide unit being configured to guide the base unit; and
a detection unit attached to the base unit, the detection unit being configured to detect vibration of the base unit, wherein
the base unit includes a first surface and a second surface opposite to the first surface, the guide unit is attached to the first surface, and
the detection unit is attached to at least one of the first surface and the second surface.

2. The liquid ejecting device according to claim 1, further comprising:
a display unit; and
a control unit, wherein
the control unit causes the display unit to indicate that the guide unit is deteriorated when the control unit determines the deterioration of the guide unit based on a detection result of the detection unit.

3. The liquid ejecting device according to claim 2, wherein
the control unit determines a deterioration factor of the guide unit based on vibration having a specific frequency extracted by analyzing the detection result of the detection unit, and causes the display unit to indicate the deterioration factor.

4. The liquid ejecting device according to claim 3, further comprising:
an application unit, wherein
the guide unit includes a rail and a block that is attached to the first surface, the block is configured to move along the rail,
the application unit is configured to provide lubricant between the rail and the block, and the control unit controls the application unit to provide the lubricant when the control unit determines that the deterioration factor is a decrease of the lubricant in the guide unit.

5. The liquid ejecting device according to claim 3, wherein
the control unit causes the display unit to display a message indicating the deterioration factor and a countermeasure for the deterioration factor.

6. A liquid ejecting device, comprising:
a head configured to eject liquid;
a holding unit holding the head;
a base unit holding the holding unit;
a displacement mechanism operatively coupling the holding unit and the base unit, and biasing the holding unit toward the base unit while maintaining a gap between the holding unit and the base unit;

a guide unit movably holding the holding unit, the guide unit being configured to guide the holding unit; and a detection unit provided at the holding unit, the detection unit being configured to detect vibration of the holding unit, wherein the holding unit includes a first surface and a second surface opposite to the first surface, and the detection unit is attached to at least one of the first surface and the second surface.

* * * * *